United States Patent [19]

Chawla

[11] Patent Number: 4,627,353

[45] Date of Patent: Dec. 9, 1986

[54] SHAPED CHARGE PERFORATING APPARATUS

[75] Inventor: Manmohan S. Chawla, Houston, Tex.

[73] Assignee: Dresser Industries, Inc., Dallas, Tex.

[21] Appl. No.: 791,634

[22] Filed: Oct. 25, 1985

[51] Int. Cl.[4] ..... F42B 1/02

[52] U.S. Cl. ..... 102/307; 102/309; 102/476

[58] Field of Search ..... 102/306–310, 102/312, 313, 476; 175/4.6

[56] References Cited

U.S. PATENT DOCUMENTS

| | | | |
|---|---|---|---|
| 3,276,369 | 10/1966 | Bell | 102/24 |
| 3,561,361 | 2/1971 | Kissenich | 102/309 X |
| 4,160,412 | 7/1979 | Snyer et al. | 102/309 X |
| 4,253,523 | 3/1981 | Ibsen | 102/310 X |
| 4,300,453 | 11/1981 | Bigler | 102/309 X |
| 4,387,773 | 6/1983 | McPhee | 175/4.6 |
| 4,428,440 | 1/1984 | McPhee | 175/4.6 |

*Primary Examiner*—Peter A. Nelson

*Attorney, Agent, or Firm*—Patrick H. McCollum

[57] ABSTRACT

A shaped charge perforating unit includes a housing having a cavity formed therein. An explosive charge of high explosive material is retained within the cavity by a liner of non-explosive material. The explosive charge consists of quantities of two explosive materials having different detonation rates.

2 Claims, 1 Drawing Figure

SHAPED CHARGE PERFORATING APPARATUS

BACKGROUND OF THE INVENTION

This invention relates in general to shaped charge perforators and more particularly, to a shaped charge perforating unit having two high explosive materials.

Explosive shaped charge well perforating devices are often used in perforating well casing and the surrounding earth formations in the production of hydrocarbons. In a typical embodiment, a plurality of shaped charges are mounted in a fluid-tight, cylindrical, metal housing or on an elongated bar member which is adapted to traverse the borehole to be perforated. The shaped charges are mounted in the housing or on the bar member at longitudinally spaced intervals, with their axis of perforating directed generally laterally thereof. A more detailed description of a typical perforating apparatus is contained in U.S. Pat. No. 4,428,440, which is incorporated herein by reference.

The shaped charge most common in well perforating is a conical shaped charge. A conical shaped charge consists of an explosive material having a substantially conical cavity formed in the front face. A metal liner material covers the face of the cavity. Upon detonation the shape of the explosive cavity focuses and propagates a progressive wave front against the outside surface of the metal liner. At the pressures generated the metal acts as a fluid. Metal in fluid form is focused into a "jet" stream. The resultant focusing force moves particles to form a jet which lengthens as the wave front advances from apex to base of the conical cavity. The extreme high pressure, particle laden, jet stream breaks down and moves aside any material upon which it impinges. Penetration of such material is a result of the amount of pressure and the kinetic energy in the jet stream. One form of conical shaped charge used in well perforating is illustrated in U.S. Pat. No. 4,387,773, which is incorporated herein by reference.

The present invention provides method and apparatus for perforating a well casing and the surrounding formations using a lined shaped charge employing an explosive material consisting of quantities of two explosive materials having different detonation rates.

SUMMARY OF THE INVENTION

A shaped charge perforating unit comprises a charge case or housing with an internal cavity formed therein. An explosive charge of high explosive material conforms an exterior shape with the inside of the cavity and is retained in place by a liner of non-explosive material. The explosive material ccmprises quantities of two explosive materials, one having a relatively high detonation rate and the other having a relatively low detonation rate.

BRIEF DESCRIPTION OF THE DRAWING

The FIGURE is a longitudinal, cross-section of a shaped charge unit in accordance with the present invention.

DETAILED DESCRIPTION OF A PREFERRED EMBODIMENT

Figure 1:
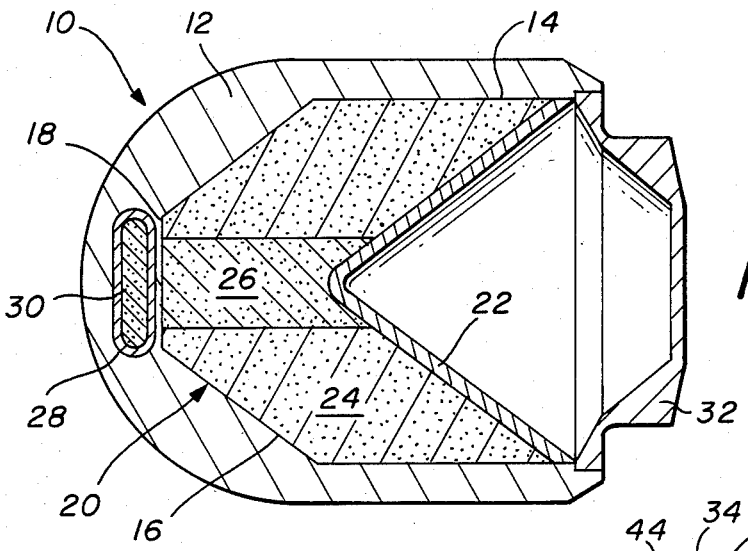
Figure 2:
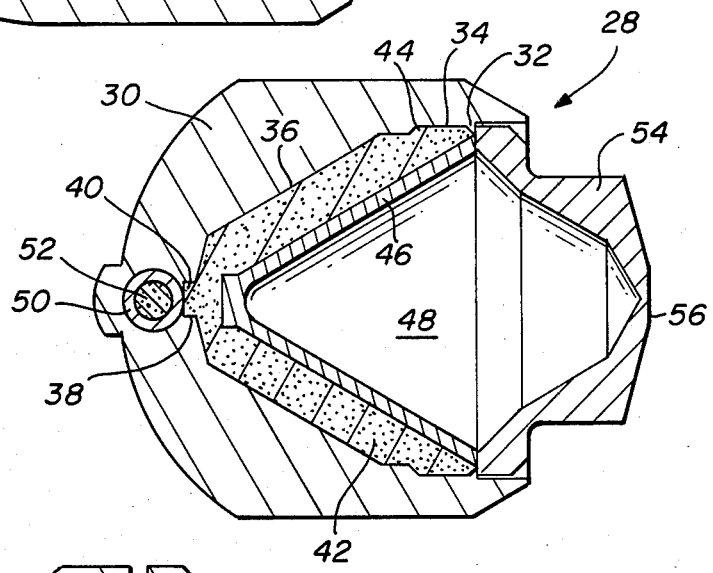
Figure 3:
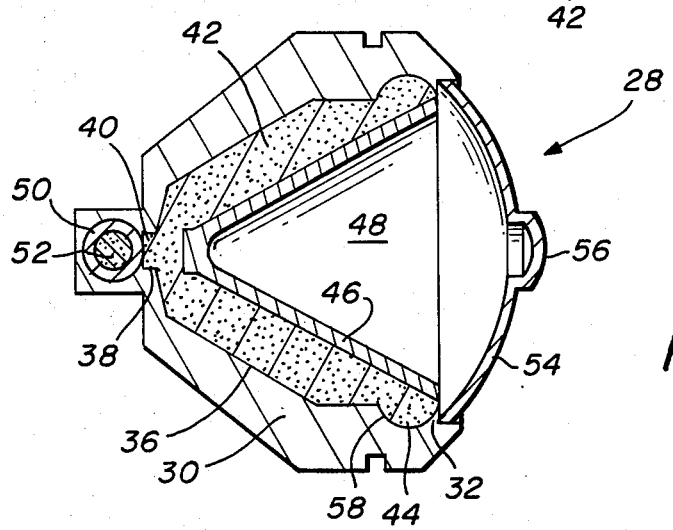

Referring now to the FIGURE, there is illustrated a lined shaped charge unit 10 adapted for use in a perforating gun for perforating oil well casing and the surrounding formations. The housing or shell 12 may be made of any suitable material, such as, for example steel. Housing or shell 12 may have any one of numerous outside configuration as is common in the art, for example a generally uniform outside diameter or a frustoconical appearance.

The cavity formed in the interior of housing 12 may be conical, hemispherical or other suitable configuration. As illustrated in the FIGURE, the cavity has a generally cylindrical forward end portion 14, a tapered, intermediate portion 16 and an apex with a reduced rear end extension 18. The explosive charge comprises a tubular or annulus shaped body of high explosive material 20, conforming in exterior shape with the shape of the inner surface of the cavity formed within housing 12. A liner 22 retains the explosive charge within housing 12. Liner 22 is illustrated as conical in shape, however, it should be recognized that it oould be of other suitable shapes, for example hemispherical. Liner 22 is constructed of a suitable non-explosive material, preferably having a relatively high density, such as, for example copper.

In the illustrated embodiment explosive material 20 consists of quantities of two high explosives having different detonation rates. A quantity of a first high explosive material 24 in the form of a circular cylinder is located proximate the apex of liner 22. Surrounding first high explosive material 24 is a quantity of a second high explosive material 26 having a detonation rate differing from that of first explosive raterial 24. Explosive material 20 should consist of a relative distribution of one-third or less of first explosive material 24 with the remainder comprising second explosive material 26.

In one embodiment of the present invention first explosive material 24 is an explosive having a relatively low detonation rate, in the range from 6,500 meters/-second to 8,000 meters/second. Examples of suitable explosive materials are hexanitrostilbene, commonly referred to as HNS, diamenotrinetrdbenzene commonly referred to as DATB. HNS, at a density of 1.70, has a detonation rate of 7120 meters/second. In this embodiment second explosive material 26 is an explosive having a relatively high detonation rate, in the range above 8,500 meters/second. Examples of suitable explosive materials are cyclotetramethylenetetranitramone, commonly referred to as HMX, or cyclotrimethylenetrinitramine, ccmmonly referred to as RDX. HMX, at a density of 1.84, has a detonation rate of 9124 meters/-second. In a second embodiment of the present invention first explosive material 24 is an explosive having a relatively high detonation rate, such as HMX or RDX, and second explosive material 26 is an explosive material having a relatively low detonation rate, such as HNS, DATB or PYX.

The rear of housing 12 is formed with a traverse opening or passage 28 adjacent the rear portion of the explosive material into which may be located a detonating fuse 30. A port plug or sealing member 32 is affixed to housing 12 to provide a fluid tight seal. Port plug 32 is formed with a relatively thin end wall positioned substantially in alignment with the axis of symmetry, the perforating axis, of the shaped charge unit.

In the operation of the invention, detonator fuse 30 is detonated by an ignitor or blasting cap (not shown). Detonator fuse 30 will detonate explosive material 20. A detonation wave thus caused travels forwardly and strikes the apex of liner 22. The wavefront continues to travel forwardly through the main explosive material section, simultaneously collapsing liner 22 symmetrically inwardly about the axis of liner 22 causing the inner surface of liner 22 to flow and form part of a jet stream. The liner material upon arrival at the axis of symmetry separates into a fast moving jet carrying most of the particles.

Many modifications and variations besides those specifically mentioned may be made in the techniques and structures described herein and depicted in the accompanying drawing without departing substantially from the concept of the present invention. Accordingly, it should be clearly understood the form of the invention described and illustrated herein is exemplary only, and is not intended as a limitation on the scope of the present invention.

The embodiments of the invention in which an exclusive property or privilege is claimed are defined as follows:

1. An explosive shaped charge comprising:

a housing having a forwardly opening cavity formed therein;

a quantity of explosive material within said cavity, said quantity of explosive material comprising first and second explosive materials having different detonation rates wherein said first explosive material comprises an explosive material having a relatively fast detonation rate, said detonation rate in a range exceeding approximately 8,500 meters/-second and wherein said second explosive material comprises an explosive material having a relatively slow detonation rate said detonation rate in a range below approximately 8,000 meters/second;

a liner cooperatively arranged to retain said explosive material in said cavity.

2. An explosive shaped charge unit comprising:

a hollow charge casing;

a shaped charge liner;

a first explosive material having a first detonation rate wherein said first explosive material comprises an explosive material having a relatively fast detonation rate; and a second explosive material having a second detonation rate wherein said second explosive material comprises an explosive material having a relatively slow detonation rate.

* * * * *